US006823934B2

(12) United States Patent
Andersson

(10) Patent No.: US 6,823,934 B2
(45) Date of Patent: Nov. 30, 2004

(54) HEAT TRANSFER PLATE AND PLATE PACK FOR USE IN A PLATE HEAT EXCHANGER

(75) Inventor: Jarl Andersson, Lund (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/239,707

(22) PCT Filed: Mar. 7, 2001

(86) PCT No.: PCT/SE01/00474

§ 371 (c)(1),
(2), (4) Date: Sep. 5, 2002

(87) PCT Pub. No.: WO01/67021

PCT Pub. Date: Sep. 13, 2001

(65) Prior Publication Data

US 2003/0047303 A1 Mar. 13, 2003

(30) Foreign Application Priority Data

Mar. 7, 2000 (SE) ..... 0000763

(51) Int. Cl.[7] ..... F28F 3/10
(52) U.S. Cl. ..... 165/167; 165/139
(58) Field of Search ..... 165/167, 139

(56) References Cited

U.S. PATENT DOCUMENTS

| | | | | |
|---|---|---|---|---|
| 2,865,613 A | * | 12/1958 | Egenwall et al. | 165/167 |
| 2,872,165 A | * | 2/1959 | Wennerberg | 165/167 |
| 3,759,308 A | | 9/1973 | Gebauer | 165/167 |
| 3,984,281 A | * | 10/1976 | Buchwald | 165/167 |
| 4,359,087 A | | 11/1982 | Johansson | |
| 4,523,638 A | | 6/1985 | Rosman et al. | 165/167 |
| 4,630,674 A | * | 12/1986 | Skoog | 165/167 |
| 4,781,248 A | * | 11/1988 | Pfeiffer | 165/167 |
| 5,327,958 A | * | 7/1994 | Machata et al. | 165/167 |
| 5,522,462 A | * | 6/1996 | Kumar et al. | 165/167 |

FOREIGN PATENT DOCUMENTS

| | | | | |
|---|---|---|---|---|
| DE | 27 48 224 | | 5/1978 | |
| EP | 0 600 189 A1 | | 6/1994 | |
| EP | 611941 A2 | * | 8/1994 | 165/167 |
| FR | 834829 | | 12/1938 | 165/167 |
| JP | 56000993 A | * | 1/1981 | 165/167 |
| WO | WO 93/15369 | | 8/1993 | |

* cited by examiner

*Primary Examiner*—Leonard R. Leo
(74) *Attorney, Agent, or Firm*—Fish & Richardson P.C.

(57) ABSTRACT

A heat transfer plate for a plate heat exchanger has a heat transfer portion (210) having elevations and depressions (30; 130; 230), a first port portion (G), a second port portion (H), first sealing portions (214, 215*a–d*), and second sealing portions (244, 216, 217). The plate has a symmetry line (S), which extends from a first edge (202) to a second edge (203) of the plate and in relation to which the plate's heat transfer portion, sealing portions and ports to be passed by each of the heat transfer fluids are symmetrically arranged. The elevations and depressions (230), are located in such manner relative to the symmetry line (S) that when two identical plates are brought to abut against each other—one of the plates being rotated through 180 degrees about the symmetry line (S)—the elevations (230) on the plates will form distance means between the plates in a large number of positions distributed over the heat transfer portions (210) of the plates.

17 Claims, 5 Drawing Sheets

HEAT TRANSFER PLATE AND PLATE PACK FOR USE IN A PLATE HEAT EXCHANGER

CROSS-REFERENCE TO RELATED APPLICATIONS

This application is a national phase application under 35 U.S.C. 371 of PCT/SE01/00474, filed Mar. 7, 2001, and claims the benefit of Swedish application 0000 763-3, filed Mar. 7, 2000.

TECHNICAL FIELD OF THE INVENTION

The present invention relates to a heat transfer plate, according to the preamble to claim 1, and a plate pack for use in a plate heat exchanger. The invention further relates to a plate heat exchanger consisting of such plates and plate packs respectively.

BACKGROUND ART

A plate heat exchanger comprises a plate pack consisting of a number of assembled heat transfer plates forming plate interspaces between them. Usually, every second plate interspace is connected with a first inlet duct and a first outlet duct, each plate interspace being arranged to define a flow area and to convey a flow of a first fluid between said inlet and outlet ducts. Correspondingly, the other plate interspaces are connected with a second inlet duct and a second outlet duct for a flow of a second fluid. Thus, the plates are in contact with one fluid through one of their side surfaces and with the other fluid through the other side surface, which allows a major heat exchange between the two fluids.

Modern plate heat exchangers have heat transfer plates, which in most cases are made of thin sheet that have been pressed and punched to obtain their final shape. Each heat transfer plate is usually provided with four or more "ports" formed by through holes being punched in the plate. The ports of the different plates define said inlet and outlet ducts, which extend through the plate heat exchanger transversely of the plane of the plates. Gaskets or any other form of sealing means are arranged around some of the ports alternately in every second plate interspace, and in the other plate interspaces around the other ports to form the two separate ducts for the first and the second fluids respectively.

Since the fluid pressure levels attained in the heat exchanger during operation are considerable, the plates need to have a certain stiffness so as not to be deformed by the fluid pressure. The use of plates made of sheet bars is possible only if these are somehow supported. As a rule, this is solved by the heat transfer plates being designed with some kind of corrugation so that the plates abut against each other in a large number of points. The plates are fixed to each other between two stiff end plates in a "rack" and thereby form stiff units with flow ducts in each plate interspace. To obtain the desired contact between the plates two different types of plates are manufactured, which are sandwiched in such manner that the plates in the heat exchanger are alternately of a first kind and of a second kind.

A modern example of a plate heat exchanger of this type is disclosed in U.S. Pat. No. 5,226,474. This plate heat exchanger is intended for evaporation of a liquid fluid taken in through a central inlet at the lower edge of each plate and discharged from the plate heat exchanger, in the form of vapour and concentrated liquid fluid, through an outlet located at one upper corner of the plate. The second fluid is taken in in the form of vapour through an inlet located at the other upper corner of the plate and discharged in the form of condensate and residual vapour through two outlets located at the two lower corners of each plate.

The manufacture of a plate heat exchanger of this type requires two different types of plates, which means that two sets of pressing tools are needed, which in turn implies big investments. The need for two different types of plates also means that large storage space is needed, both for the finished plates and for the pressing tools. Furthermore, the tools have to be changed in connection with the pressing of the plates.

Ever since the manufacture of plate heat exchangers with heat transfer plates made of sheet bars started, a solution which means that only one type of plate is needed has been in demand in the industry, since this would be more cost-effective.

There are some cases today where only one type of plate is used, for example in applications subject to two fundamental design requirements: on the one hand that inlets and outlets for each heat exchanging fluid can be located at the same lateral edge of the plates and, on the other, that the plates can be designed in such manner that size of the inlets and outlets is the same for the respective fluids. An example of such a plate is disclosed in U.S. Pat. No. 4,359,087.

In such specific cases, it is ensured that the ports and sealing elements of the plates, such as weld-prepared ridges and/or gaskets, are arranged symmetrically about a symmetry line located in the centre of the plate between the inlet and the outlet of the two fluids and extending transversely of the main flow direction of the fluids. The plates of the heat exchanger are arranged in such a way that every second plate is rotated or "flipped" through 180 degrees about its symmetry line. The location requirement concerning the inlets and outlets is due to the fact that the location of the sealing means relative to the ports that define the inlet and outlet ducts has to be the same for all plates. Locating the inlets and outlets this way means, however, that only part of the plate surface is used efficiently for heat transfer, since great flow rate differences arise between a partial flow taking the shortest way from the inlet to the outlet and a partial flow describing on its way from the inlet to the outlet a curved path via the opposite edge of the plate.

There are other applications where, as a standard solution, only one type of metal plate is used, but different types of gaskets in every second interspace, to constitute the whole plate heat exchanger. In this type of structure, every second plate is rotated through 180 degrees in the plane about a centre line extending, accordingly, perpendicularly to the plane of the plate. This means, just as in the above case, that the different ports have to be of the same size. In this plate design, different kinds of stiffening means in the form of special gaskets or weigh belts are also often used. However, this entails additional costs for manufacture and mounting of the stiffening means. In addition, these stiffening means often have a detrimental effect on the functioning of the heat exchanger since they interfere with the flow in an undesired way.

A further example of prior art is to be found in GB-A-2,121,525, which discloses a plate heat exchanger in the form of an evaporator provided with two different types of plates in a plate pack.

There are, however, a large number of applications where the above special cases are not applicable. For example, they cannot be used when one or both fluids undergo a phase transformation. There are evaporation and/or condensation processes, for example, where a liquid is transformed into vapour and vapour is transformed into liquid, which requires different sizes of the inlets and outlets for the respective fluids (see the above-mentioned U.S. Pat. No. 5,226,474).

Thus, there is no general technique for reducing to only one the number of plate types in one and the same plate heat exchanger. The attempts at solving the problem proposed have either been limited to very special applications or require special stiffening means and gaskets resulting in a more expensive and poorer construction, which means that the economic benefit of only one type of plate is lost.

There is above all a great need for a reduced number of plate types in various forms of condensation and evaporation applications, since these require relatively large plates in order to achieve an efficient heat exchange even if one of the fluids is in the vapour phase. The need is even more pronounced in connection with large-scale industrial operation processes.

SUMMARY OF THE INVENTION

The object of the invention is to provide a solution to the above problems.

More specifically, the primary object of the invention is to provide a heat exchanging plate, which is constructed in such a way that a plate heat exchanger can be manufactured at the lowest possible cost, the flow of each of the two heat exchanging fluids in the plate heat exchanger being as evenly distributed as possible in the respective plate interspaces. Furthermore, the construction shall be such that the heat transfer plate, when it is assembled with similar plates in a plate heat exchanger, is able to resist large pressure differences between the heat exchanging fluids. In addition, the construction should be such that the above advantages may be obtained even if one or both fluids are intended to undergo a phase transformation during the heat exchange in the plate heat exchanger, and each heat exchanging plate, therefore, has to be provided with an inlet port area of a different size than the outlet port area for each of the fluids, or only one of the fluids.

According to the invention, this object is achieved by means of a heat transfer plate of the type described by way of introduction and having the features defined in claim 1.

The invention also concerns a plate pack for use in a plate heat exchanger, which comprises a number of heat transfer plates as above and also has the features defined in claim 17.

Furthermore, the invention concerns a plate heat exchanger, which has the features defined in claim 21.

Finally, the invention also concerns use of a heat transfer plate of the type described above.

Preferred embodiments of the invention will be apparent from the dependent claims.

The fact that the plate has a symmetry line, which extends in the main flow direction of the heat exchanging fluids from said first edge to said second edge of the plate and relative to which the plate's heat transfer portion, sealing portions and ports to be passed by each of said fluids are symmetrically arranged results in a plate that can be flipped about its symmetry line and brought to abut against another identical plate for forming a pair of plates or a plate pack with several plates of one and the same type.

To ensure that the plate, when it is assembled with identical plates in a plate heat exchanger, is able to resist large pressure differences between the heat exchanging fluids, said elevations and depressions are so arranged relatively to said symmetry line that when two identical plates are brought to abut against each other—one of the plates being rotated through 180 degrees about the symmetry line relative to the other—said elevations of the plates will form distance means between the plates in a number of places distributed over the heat transfer portions of the plates.

Owing to the symmetry properties only one type of plate is required, which means that only one set of pressing tools is needed, which in turn implies smaller investments compared to prior art.

The above symmetry requirements are such that the inlet ports and outlet ports for the respective fluids can be given a different shape and total area, which means that the plate can also be used in plate heat exchangers where one or both fluids undergo a total or partial phase transformation.

The symmetric location of the ports also has the advantage that the fluid flows will cover the major part of the plate surfaces instead of only flowing along one or the other of the edges of the plates. Furthermore, the symmetric location results in a smaller difference in flow paths and thereby in flow rates between different partial flows of a fluid in one and the same plate interspace. This ensures a high efficiency of the heat exchanger, meaning that for a given heat-exchanging task smaller and, thus, cheaper plates can be used. Moreover, the risk of the fluid flow in any portion of the plates becoming so small that this portion "runs dry", which could mean that one of the fluids gets burnt and sticks to the plate at this portion, is reduced.

The plates are advantageously formed with circumferential ridges delimiting the desired flow areas on the respective sides of the plates. These ridges form both distance means and sealing means.

A preferred way of ensuring that the distance means are symmetric point by point with respect to the symmetry line is to provide the plate with elongated corrugations that form ridges arranged asymmetrically relative to the symmetry line.

When plates of the type mentioned above are used in a plate pack, in which every second plate is flipped through 180 degrees about said symmetry line relative to the other plates, a plate pack is obtained which is well suited for welding in pairs, but which may also be used in combination with an optional sealing system. Flipping every second plate about the symmetry line results in the ports and distance means coinciding with the corresponding elements on an adjacent plate. The plates will be arranged so that the first side of each plate faces the first side of an adjacent plate and the second side of each plate faces the second side of an adjacent plate.

BRIEF DESCRIPTION OF THE DRAWINGS

The invention will be described in more detail below with reference to the accompanying schematic drawings, which by way of example illustrate currently preferred embodiments of the invention according to its different aspects.

DETAILED DESCRIPTION OF PREFERRED EMBODIMENTS

Heat transfer plates designed according to the invention are intended for use in a conventional plate heat exchanger, the operation of which will thus not be described in more detail.

Figure 1:
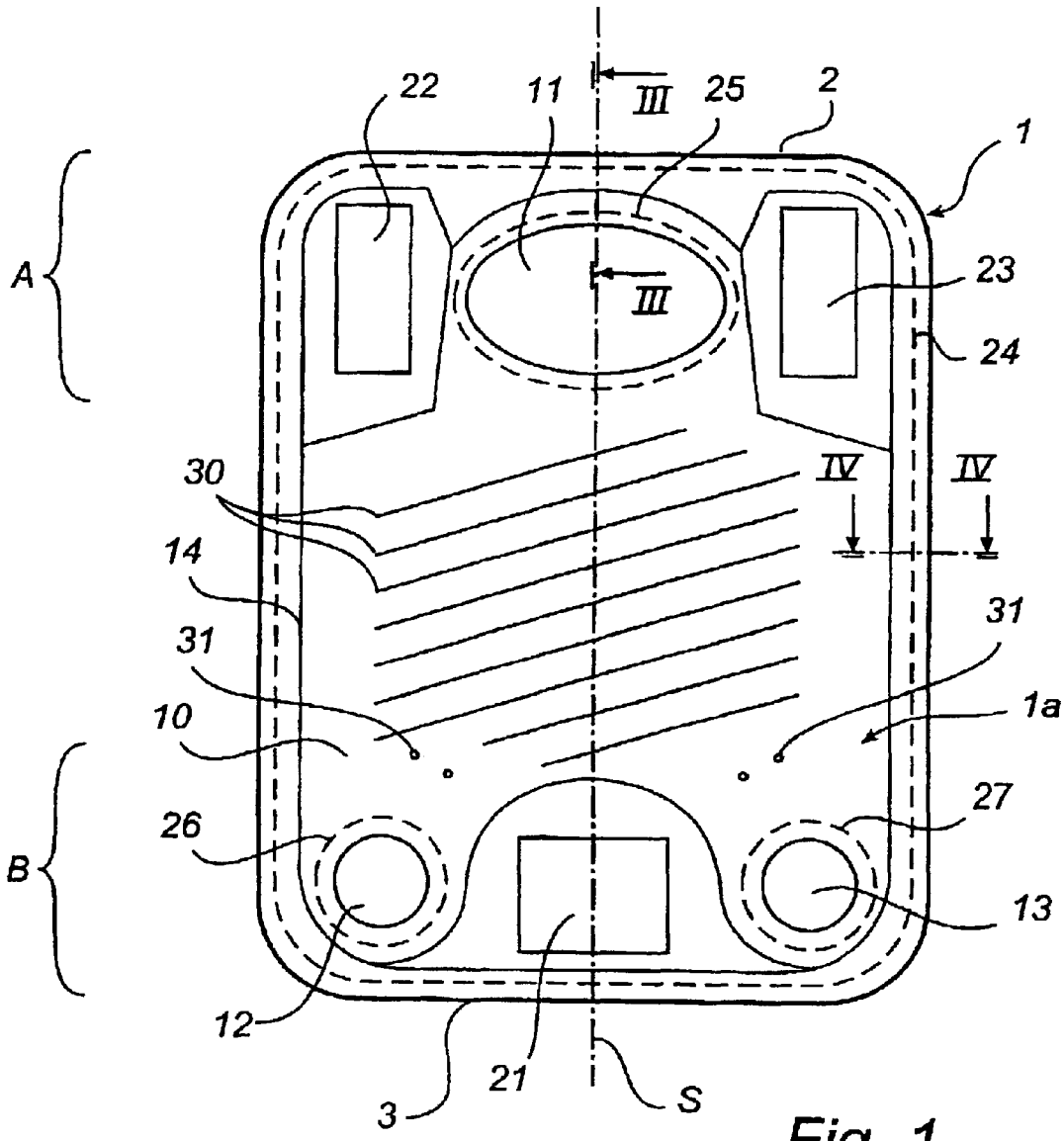
FIG. 1 is a plan view of a heat transfer plate according to the invention as seen from one side of the plate.
Figure 2:
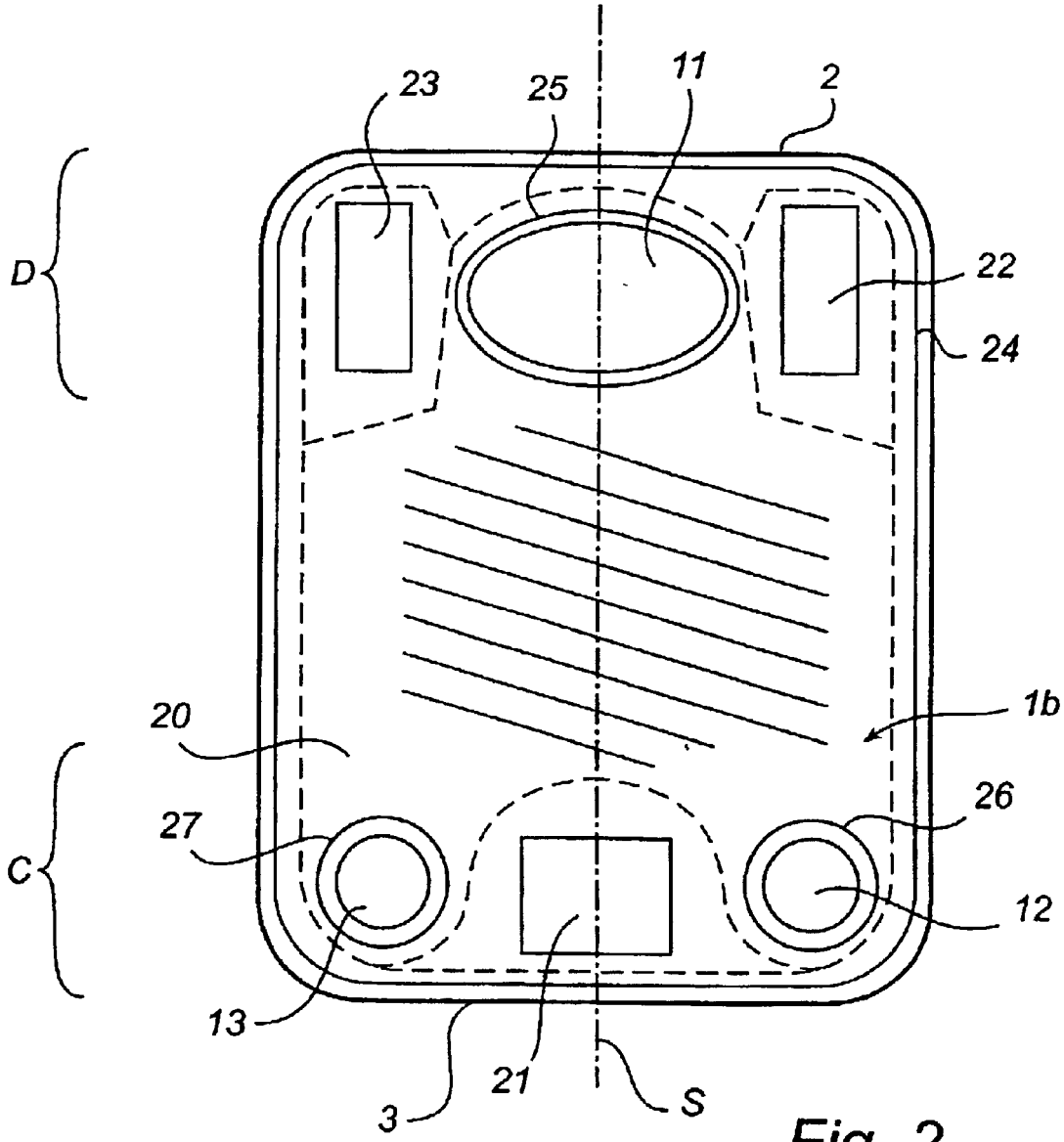
FIG. 2 shows the same heat transfer plate as seen from the other side relative to FIG. 1.

A heat transfer plate 1 according to the invention consists of pressed thin sheet and has, as seen in FIGS. 1 and 2, a rectangular main outline. On its one (first) side or side 1*a* (see FIG. 1) the plate 1 has, at its one (first) edge 2, or short side, a first inlet portion A. Furthermore, the plate 1 has on its first side 1*a*, at the second edge 3 opposite to the first edge 2, a first outlet portion B.

The plate 1 has a geometrical symmetry line S extending between the first inlet portion A and the first outlet portion B.

The first inlet portion A and the first outlet portion B communicate with each other, in terms of flow, through a first flow area or heat transfer portion 10 on the first side 1*a* of the plate 1. The first inlet portion A has a first, centrally arranged inlet port 11 defined by a through hole, which is centrally located in such a way that it is crossed or intersected by the symmetry line S and which is symmetrically shaped on both sides of this line. The first outlet portion B comprises two first outlet ports 12 and 13, which in terms of shape and location are symmetric with respect to the symmetry line S. The shape of the two outlet ports 12, 13 is identical, and they are each others mirror image with respect to the symmetry line S and located at the same distance from the symmetry line S.

On its second side 1*b* (see FIG. 2) the plate 1 has a second inlet portion C located at the same edge 3 as the first outlet portion B and comprising a second inlet port 21. On its second side 1*b* the plate also has a second outlet portion D located at the opposite edge 2 and comprising two second outlet ports 22 and 23. The two outlet ports 22, 23 are also symmetric in terms of shape and location in so far as they have the same shape and are each other's mirror image with respect to the symmetry line S and located at the same distance from the symmetry line S. The second inlet portion C and the second outlet portion D communicate with each other in terms of flow through a second flow area or heat transfer portion 20 on the second side 1*b* of the plate 1.

The six ports 11–13 and 21–23 previously described are all symmetrically arranged relative to the symmetry line in so far as the ports 12, 13 and 22, 23 being located at a distance from the symmetry line have other ports 13, 12 and 23, 22, which are exact mirror images of the former, and in so far as the ports 11, 21 being intersected by the symmetry line are divided in two by this line and have two identical halves, which are mirror images with respect to the symmetry line S.

The first inlet portion A and the second outlet portion D are arranged at the same edge 2 and have essentially the same extension along the symmetry line S. Since the ports 11, 22, 23 are formed of through holes the first inlet portion A may be considered, in a certain geometrical sense, to comprise the second outlet ports 22, 23, but as will be apparent from the following these ports 22, 23 are not connected, in terms of flow, with the first inlet portion A. The corresponding geometrical as well as flow-oriented definitions also apply to the first inlet port 11 and to the ports 12, 13, 21, which are formed in the first outlet portion B and the second inlet portion C.

For the purpose of clarity the ports intended for conveying a first fluid are marked as round or elliptic while the ports intended for conveying a second fluid are marked as quadrangular. The shape of the ports may naturally be varied according to the types of fluid for which the plate heat exchanger is intended.

The inlet port 11 for the first fluid has a total area that is bigger than the total area of the two outlet ports 12, 13 for the first fluid. The inverse relation applies to the ports 21–23; the total outlet area is bigger than the inlet area. Thus formed, the plate is intended for condensation of the first fluid and evaporation of the second fluid.

The plate 1 has a material thickness of about 0,4–1 mm and is provided with depressions and elevations in such a way that it extends between two parallel geometrical planes P1 and P2 located at a distance of 2–10 mm from each other. However, these two dimensions are heavily dependent on the intended application of the plate. The depressions and elevations are formed in such a way that they on the one hand constitute distance means, gasket grooves and/or sealing surfaces and, on the other, control the fluid flow.

The elevations comprise a first circumferential continuous ridge 14 on the first side 1*a* of the plate 1. The ridge 14 forms a loop which encompasses and delimits the above first flow area 10 on the first side 1*a* of the plate 1. The ridge 14 further encompasses the first inlet port 11 and said first outlet ports 12, 13. The form of the ridge 14 is such, however, that the second inlet port 21 and said second outlet ports 22, 23 are located outside the loop. Moreover, the height of the ridge 14 is such that it is tangent to the first geometrical plane P1 along its entire extension. This shape of the ridge 14 means that when the plate 1 is brought to abut against an identical plate that has been rotated or "flipped" 180 degrees about said symmetry line S, the ridges 14 of the two plates will abut against each other and delimit a closed space 10 connecting the first inlet port 11 with the two first outlet ports 12, 13. The closed space 10 is sealed by the crests of the two ridges 14 of the plates being welded together so that the two plates become fixedly attached to each other. Through the welding the closed space 10 is also sealed against the surroundings.

The depressions comprise a groove which forms a second circumferential continuous ridge 24 on the second side 1*b* of the plate 1. This ridge 24 forms a loop which encompasses the entire plate 1. The ridge 24 on the second side 1*b* of the plate 1 is located closer to the edge of the plate 1 than the ridge 14 on the first side 1*a* of the plate 1. The second ridge 24 encompasses all the ports 11–13, 21–23 and said second flow area 20 on the second side 1*b* of the plate 1. The height of the ridge 24 is such that it is tangent to the second geometrical plane P2 along its entire extension. This shape of the ridge 24 means that when the plate 1 is brought to abut against an identical plate that has been rotated or "flipped" 180 degrees about said symmetry line S, the ridges 24 of the two plates will abut against each other and delimit a closed space 20 connecting the second inlet port 21 with the two second outlet ports 22, 23.

To ensure that the closed space 20 is not connected with the ports 11–13 for the first fluid, the plate 1 has on its second side 1*b* a number of continous ridges 25–27 which encompass these ports 11–13 and which are also tangent to the second geometrical plane P2 along their entire extension. These ports 11–13 are thereby delimited so that they are not connected to said closed space 20. The closed space 20 is sealed by the crests of the ridges 24–27 of the two plates extending along the periphery and encompassing the ports being welded together so that the two plates are fixedly attached to each other. Through the welding the closed space

20 is also sealed against the surroundings. The ridges 25–27 encompassing the ports are located closer to the respective ports 11–13 than the ridge 14 on the first side 1*a* of the plate 1. Such welding together of several plates is described in more detail in, for example, EP-A-623 204.

According to an alternative embodiment, the outer ridge 24 of the second side 1*b* of the plate 1 may be replaced by a gasket 40 suitably located in the valley on the second side 1*b* that is formed by the back of the ridge 14 on the first side 1*a*. In this case, the crests 25–27 on the second side 1*b* around the first inlet port 11 and the two first outlet ports 12, 13 are suitably replaced with a gasket groove and a gasket. This way of welding in pairs and arranging a gasket in every second gap is disclosed in the U.S. Pat. No. 4,359,087 mentioned by way of introduction.

The central portion of the plate 1, i.e. the portion of the plate 1 that is located between the inlet and outlet portions, has a number of elongated corrugations 30 forming ridges and valleys, alternately, on both sides of the plate 1. The corrugations 30 are tilted and thus cross the symmetry line S of the plate 1 at an angle other than 90 degrees, thereby being asymmetrically arranged with regard to the symmetry line S. The relative distance, extension, profile, location and orientation of the corrugations 30 is largely determined by the fluid flows for which the heat exchanger is intended. The corrugations may, for example, be arranged in a herringbone pattern along a direction perpendicular to the symmetry line S (see FIG. 6 and FIG. 7). At least some of said corrugations are tangent to said geometrical planes P1, P2 so that when to plates are brought to abut against each other, the asymmetrical ridges will abut against each other crosswise in a large number of points. These points ensure that the plates are correctly spaced in relation to each other and give the support required for each plate to avoid deformation of the plate due to the pressure that the fluids exert on each plate during operation. The points, defined by the abutment of the asymmetrical corrugations 30 against each other, are symmetrically arranged relatively to the symmetry line S. Thus, the corrugations 30 serve two purposes: they are intended to affect the fluid flow and they serve as distance means between the plates.

As a complement or an alternative to the asymmetric elongated corrugations 30 the plate can be made to have short ridges or concentrated protrusions 31, which in that case are symmetrically arranged relatively to the symmetry line S.

Plates of the type described above are used in plate packs for plate heat exchangers. A number of plates are assembled in a pack so that they are parallel in relation to each other and abut against each other by means of the ridges, protrusions, corrugations and possible gaskets described above. Every second plate of the plate pack is rotated or "flipped" through 180 degrees about said symmetry line. This results in the respective ports of the plates coinciding to form ducts, which extend through the plate pack. Furthermore, the circumferential ridges and the flow areas form, in the way described above, the closed spaces or flow ducts in the plate interspaces. The flow duct of every second plate interspace is connected with said first inlet and outlet ports and the flow ducts of the other interspaces are connected with said second inlet and outlet ports.

Figure 3:
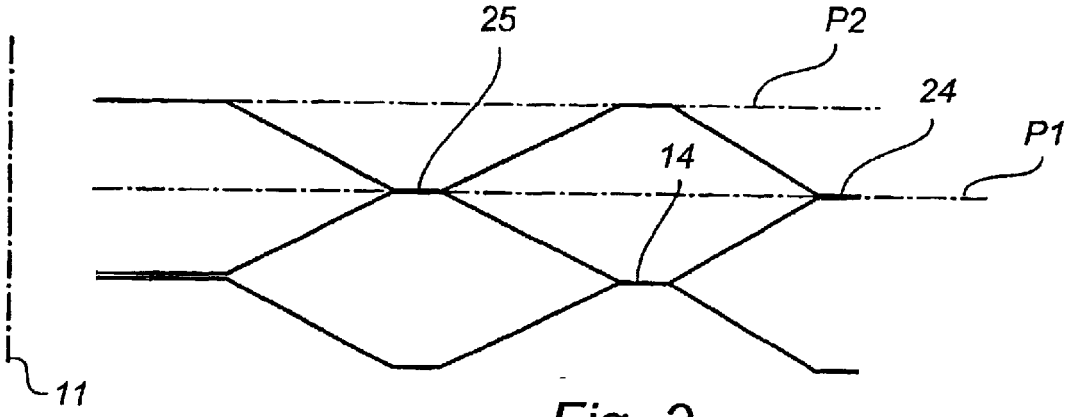
FIG. 3 is a cross-section along the line III—III in FIG. 1.
Figure 4:
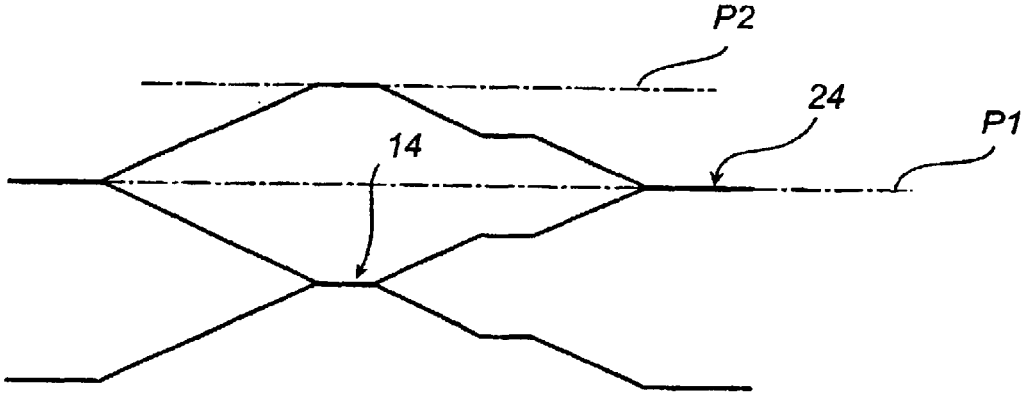
FIG. 4 is a cross-section along the line IV—IV in FIG. 1.

According to an embodiment, the plates of the plate pack are fixedly attached to each other by welding together the ridges of the plates abutting against each other (see FIG. 3 and FIG. 4). When all the plates are fixedly attached to each other, the ridges encompassing the flow areas 10 and 20 respectively and the ridges 25–27 encompassing those ports 11–13 that should not be connected with the second flow area 20 are welded together.

According to another embodiment, the plates of the pack are only fixedly attached to each other in pairs by welding together the abutting ridges of the two plates (not shown). For example, the ridges of the second side 1*b* of the respective plates can be welded together and the back of the circumferential ridge can be used as a gasket groove on the first side 1*a* of the respective plates. Thus only one simple gasket is required. Accordingly, the plate pack consists of a number of plate pairs, "cassettes", wherein gaskets are arranged between the plate pairs.

Figure 5:
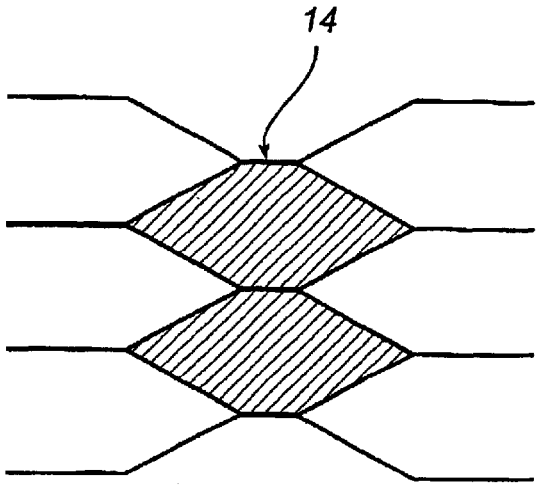
FIG. 5 is a cross-section along the line IV—IV in FIG. 1 according to an alternative embodiment.

The current use of the heat exchanger determines whether the plates should be attached in pairs, not attached at all or attached all together. For example, the plates can be welded in pairs and gaskets arranged in every second interspace. This is convenient, for example, when one fluid is water and the other fluid is a food product, or any other product requiring cleaning of the plates. In this case, the water is conveyed through the fixedly attached pairs of plates, and the second fluid is conveyed in the interspaces sealed by means of gaskets, the interspaces being thus accessible for cleaning (see FIG. 5).

According to an alternative embodiment, the plate 101 having a rectangular main outline (see FIG. 6) comprises a first port portion E at a first edge 102 of the plate 101 and a second port portion F at a second edge 103 located opposite the first edge 102. The two port portions E, F each has three ports 111–112, 121–124. The central port 111 of the first portion E is the inlet port for a first fluid and the central port 112 of the second portion F is the outlet port for the first fluid. The two outer ports 121, 122 of the second port portion F are inlet ports for a second fluid and the two outer ports 123, 124 of the first port portion E are outlet ports for the second fluid.

Figure 6:
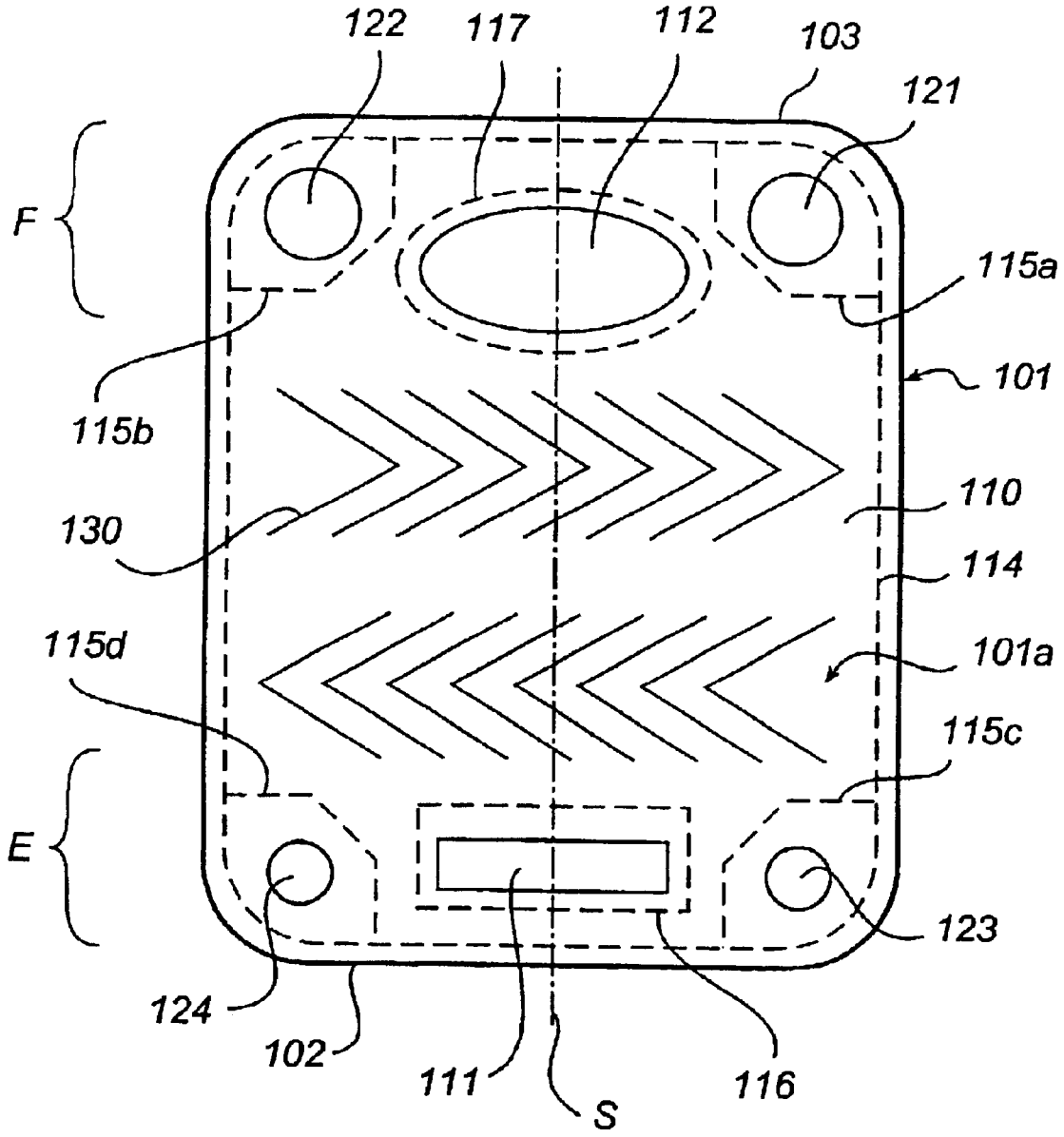
FIG. 6 shows a heat transfer plate according to an alternative embodiment of the invention intended for welding in pairs.

The plate 101 shown in FIG. 6 is intended for welding in pairs, i.e. the plates should be fixedly attached in pairs and the plate pairs should be sealed in relation to one another by means of gaskets. The plate 101 has a number of depressions or grooves 114, 115*a–d*, 116, 117, some of which are intended to receive gaskets.

The plate 101 comprises a groove 114 extending along the entire periphery of the plate 101, which is pressed using the entire press depth and arranged to receive a gasket. On the back of the plate 101 in FIG. 6 said groove 114 will form a ridge, which will abut against a corresponding ridge of an abutting plate, the ridges being welded together.

The plate 101 further comprises grooves 115*a–d* located at the respective corners of the plate 101. These corner grooves 115*a–d* connect to the circumferential groove 114 and are each arranged to receive a gasket. However, the grooves 115*a–d* are not pressed using the entire press depth, which means that the ridges formed by these grooves 115*a–d* on the second side of the plate 101 will not abut against the corresponding ridges of an abutting plate. The reason is that the ports 121–124 located in the corners should be connected with each other through the heat transfer surface 120 on said second side of the plate. To obtain a sufficient sealing pressure the corner grooves 115*a–d* may be provided with a number of concentrated recesses that are pressed using the entire press depth in such a way that the ridges formed on the second side of the plate will abut against each other in certain points. Alternatively, weigh belts can be arranged on the back of the plate 101 in order to obtain a sufficient sealing pressure. Thus, the gaskets in the grooves 115*a–d* are thinner than the gasket provided in the groove 114.

The plate 101 further comprises a groove 116 encompassing the inlet port 111 and a groove 117 encompassing the outlet port 112 for the first fluid. The grooves are pressed using the entire press depth and are intended to be welded together on the back as the back of the circumferential groove 114. The grooves 111, 112 encompassing the ports are not, however, intended to receive any gasket.

With the embodiment of the plate 101 described above the first fluid will flow between the central ports 111, 112 and along the front or first side of the plate shown in FIG. 6. The gaskets in the corner grooves 115*a–d* and the gasket in the circumferential groove 114 provide a seal between this flow and the surroundings and the ports 121–124 located in the corners. On the second side of the plate 101 the second fluid will flow. The welding of the back sides of the circumferential groove 114 and the grooves 116, 117 encompassing the ports provide a seal between this flow and the surroundings and the central ports 111, 112 respectively. Since the corner grooves 115*a–d* are not pressed using the entire press depth, the second fluid is able to flow between the ports 121–124 and the heat transfer surface. This plate 101 also comprises a number of depressions and elevations 130 formed in the heat transfer portion 110 of the plate 101, which form distance means as described above. In this case, the depressions and elevations are formed as a corrugation arranged in a "herringbone pattern", i.e. each corrugation ridge consists of two ridge portions tilted relatively to each other and forming an arrow shape. Several such arrow-shaped ridge portions and intermediary valleys are arranged along a common "arrow" or herringbone line.

Figure 7:
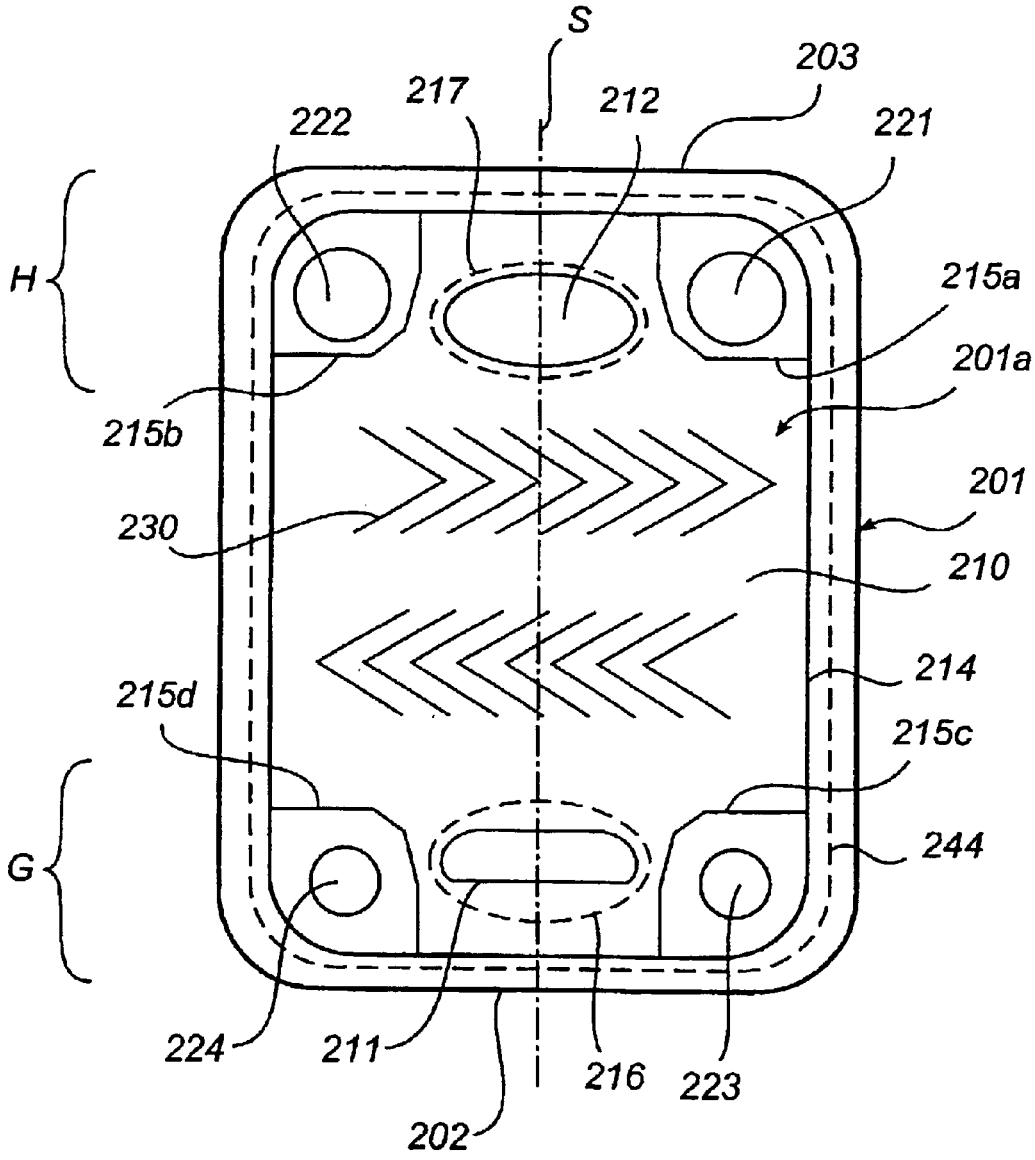
FIG. 7 shows a heat transfer plate which corresponds to the plate shown in FIG. 6 and which is intended for all-welding.

FIG. 7 shows a plate 201, which has the same port configuration as the plate 101 in FIG. 6 and is intended for all-welded constructions.

The plate 201 has an elongated rectangular main outline and comprises six ports 211, 212, 221–224 that are arranged in port portions located at the two short sides of the plate 201. The plate 201 comprises a heat transfer portion 210 between the port portions.

The plate 201 further comprises a central port 211, 212 in each of the port portions, the ports being intended to be connected with each other through a flow area across one side 201*a* of the heat transfer portion 210 of the plate 201. A seal between this flow area and the surroundings is provided by a ridge 214 which extends along the entire periphery of the plate 201 and which is intended to abut against and be welded onto a corresponding ridge on an adjacent plate. The plate 201 further comprises four ridge portions 215*a–d* connecting to and encompassing and sealing, together with the circumferential ridge 214, four ports 221–224 located in the respective corners of the plate 201, said ports being intended to be connected with each other through the second side of the plate 201. The corner ridges 215*a–d* are also intended to be welded onto the corresponding ridges of an abutting plate.

On its second side (opposite the side 201*a* shown in FIG. 7) the plate 201 has a ridge 244 extending along the periphery. This ridge 244 is intended to abut against and be welded onto a corresponding ridge of an abutting plate for providing a seal between the flow area on the second side of the plate 201 and the surroundings. To ensure that the central ports 211, 212 are not connected with this flow area the plate 201 has two additional ridges 216, 217 on its second side encompassing the respective central ports 211, 212. These ridges 216, 217 are also intended to be welded onto the corresponding ridges of an abutting plate.

In addition, the plate 201 comprises corrugations 230, which form a herringbone pattern in the heat transfer portion of the plate 201. The corrugations are intended to serve as distance means.

It is to be appreciated that a number of modifications of the embodiments described herein are possible within the scope of the invention, as defined in the appended claims.

Other materials with sufficient heat transfer capacity may be used, for example, in the heat transfer plates instead of metal. This applies particularly when a fluid is corrosive, aggressive or in any other way not suitable for use in connection with metals. Different metals may also be used in different applications depending on the fluids conducted through the heat exchanger.

Any other process such as gluing or soldering, which provides a fixed attachment and an adequate sealing, can replace the welding.

Furthermore, there are other variants of the configuration of the plates with respect to fixed attachments and gaskets respectively. For example, the plates may be fixedly attached to plate packs consisting of ten plates, wherein several plate packs are assembled to form a plate heat exchanger in which gaskets are arranged to provide a seal between adjacent plate packs.

What is claimed is:

1. A plate pack for a plate heat exchanger comprising a plurality of heat transfer plates, each comprising a heat transfer portion (10, 20, 110, 120; 210, 220) located between two opposite edges (2, 3; 102, 103; 202, 203) of the plate (1; 101; 201) and having, on a first side (1*a*; 101*a*; 201*a*) of the plate, elevations and depressions (30; 130; 230), which form the corresponding elevations and depressions on the opposite second side (1*b*; 101*b*; 201*b*) of the plate, a first port portion (A, D; E; G) located at a first edge (2; 102; 202) of the edges and having at least one port (11; 111; 211) to be gassed by a first fluid and at least one port (22, 23; 123, 124; 223, 224) to be passed by a second fluid, a second port portion (B, C; F; H) located at a second edge (3; 103; 203) of the edges and having at least one port (12, 13; 112; 212) to be gassed by the first fluid and at least one port (21; 121, 122; 221, 222) to be passed by the second fluid, first sealing portions (14; 114, 115*a–d*; 214, 215*a–d*) encompassing on the one hand, on the first side (1*a*; 101*a*; 201*a*) of the plate, a first surface which covers the heat transfer portion (10; 110; 210) of the plate as well as the ports (11–13: 11, 112: 211, 212) to be passed by the first fluid, and separately encompassing, on the other hand, the ports (21–23; 121–124; 221–224) to be passed by the second fluid, and second sealing portions (24–27; 114, 116, 117; 244, 216, 217) encompassing on the one hand, on the opposite second side (1*b*; 101*b*; 201*b*) of the plate, a second surface, which covers the heat transfer portions (10; 110; 210) of the plate as well as the ports (21–23; 121–124; 221–224) to be passed by the second fluid, and encompassing separately, on the other hand, the ports (11–13; 111, 112, 211, 212) to be passed by the first fluid, whereby the ports for the first fluid, when the plate forms part of a plate heat exchanger, are arranged to communicate with a first passing space delimited by the first side of the plate in the area of the heat transfer portion, whereas the ports for the second fluid are arranged to communicate with a second passing space delimited by the opposite second side of the plate in the area of the heat transfer portion, wherein the plate has a symmetry line (S), which extends from the first edge (2; 102; 202) to the second edge (3; 103; 203) of the plate and in relation to which the plate's heat transfer portion, sealing portions and ports to be passed by each of the fluids are symmetrically arranged, and the elevations and depressions (30; 130; 230) are arranged relative to the symmetry line (S) in such manner that when two identical plates are brought to abut against each other—one of the plates being rotated through 180 degrees about the symmetry line (S) relative to the other—the elevations (30; 130; 230) of the plates will form distance means between the plates in a number of places distributed over the heat transfer portions (10; 110; 210) of the plates and every second heat transfer plate being rotated through 180 degrees about the symmetry line so that the heat transfer plates of the plate pack abut against each other with the first side (1*a*; 101*a*; 201*a*) of the respective plates facing the first side (1*a*; 101*a*; 201*a*) of an adjacent plate and the second side (1*b*; 101*b*; 201*b*) of the respective plates facing the second side (1*b*; 101*b*; 201*b*) of an adjacent plate, and further wherein the plates are permanently and sealingly interconnected in pairs to form pairs of plates and gaskets are arranged between adjacent pairs of plates.

2. A plate pack according to claim 1, wherein the first sealing portions comprise a first ridge (14; 114; 214) located on the first side of the plate and extending around the first surface.

3. A plate pack according to claim 2, wherein the extension of the first ridge (14; 114; 214) is symmetric relative to the symmetry line (S).

4. A plate pack according to claim 2 or 3, wherein the back of the first ridge (14; 114; 214) forms a gasket groove on the second side of the plate.

5. A plate pack according to claim 4, wherein the second sealing portions comprise a second ridge (24; 114; 244) located on the second side of the plate and extending around the second surface.

6. A plate pack according to claim 5, wherein the extension of the second ridge (24; 114; 244) is symmetric relative to the symmetry line (S).

7. A plate pack according to claim 1, wherein the total port area for one of the fluids in the first port portion (A, D; E; G) has a different size for the same fluid in the second port portion (B, C; F; H).

8. A plate pack according to claim 1, wherein the total port area for each of the fluids in the first port portion (A, D; E; G) has a different size than the total port area for each fluid in the second portion (B, C; F; H).

9. A plate pack according to claim 7 or 8, wherein the total port area for each of the fluids is larger in the first port portion (A, D; E; G) than in the second port portion (B, C; F; H).

10. A plate pack according to claim 1, wherein the first port portion (A, D; E; G) comprises a central inlet port (11; 111; 211) which is intersected by the symmetry line (S).

11. A plate pack according to claim 1, which comprises at least three ports at the first edge (2; 102; 202) and three ports at the second edge (3; 103; 203) of the plate.

12. A plate pack according to claim 10 or 11, which has three ports in each port portion, the middle port (11) at the first edge being connected with the two outer ports (12, 13) at the second edge and the middle port (21) at the second edge being connected with the two outer ports (22, 23) at the first edge.

13. A plate pack according to claim 10 or 11, which has three ports in each port portion, the middle port (111;211) at the first edge being connected with the middle port (112; 212) at the second edge, and the two outer ports (122, 122) at the second edge being connected with the two outer ports (123, 124) at the first edge.

14. A plate pack according to claim 1, which has an essentially elongated rectangular shape, wherein the port portions are located at the respective short sides.

15. A plate pack according to claim 1, wherein the distance means comprise a number of ridges (30; 130; 230) that are asymmetrically arranged relative to the symmetry line, so that when two identical plates are brought to abut against each other—one of the plates being rotated through 180 degrees about the symmetry line relative to the other—the ridges on the respective plates will abut against each other crosswise in a large number of positions distributed over the heat transfer portions (10; 110; 210) of the plates.

16. A plate pack according to claim 15, wherein the ridges (30; 130; 230) extend parallel in a direction forming an angle with the symmetry line.

17. A plate heat exchanger, comprising at least one plate pack, the plate pack having a plurality of heat transfer plates, each comprising a heat transfer portion (10, 20, 110, 120; 210, 220) located between two opposite edges (2, 3; 102, 103; 202, 203) of the plate (1; 101; 201) and having, on a first side (1*a*; 101*a*; 201*a*) of the plate, elevations and depressions (30; 130; 230), which form the corresponding elevations and depressions on the opposite second side (1*b*; 101*b*; 201*b*) of the plate, a first port portion (A, D; E; G) located at a first edge (2; 102; 202) of the edges and having at least one port (11; 111; 211) to be passed by a first fluid and at least one port (22, 23; 123, 124; 223, 224) to be passed by a second fluid, a second port portion (B, C; F; H) located at a second edge (3; 103; 203) of the edges and having at least one port (12, 13; 112; 212) to be passed by the first fluid and at least one port (21; 121, 122; 221, 222) to be passed by the second fluid, first sealing portions (14; 114, 115*a–d*; 214, 215*a–d*) encompassing on the one hand, on the first side (1*a*; 101*a*; 201*a*) of the plate, a first surface which covers the heat transfer portion (10; 110; 210) of the plate as well as the ports (11–13: 11, 112: 211, 212) to be passed by the first fluid, and separately encompassing, on the other hand, the ports (21–23; 121–124; 221–224) to be passed by the second fluid, and second sealing portions (24–27; 114, 116, 117; 244, 216, 217) encompassing on the one hand, on the opposite second side (1*b*; 101*b*; 201*b*) of the plate, a second surface, which covers the heat transfer portions (10; 110; 210) of the plate as well as the ports (21–23; 121–124; 221–224) to be passed by the second fluid, and encompassing separately, on the other hand, the ports (11–13; 111, 112, 211, 212) to be passed by the first fluid, whereby the ports for the first fluid, when the plate forms part of a plate heat exchanger, are arranged to communicate with a first passing space delimited by the first side of the plate in the area of the heat transfer portion, whereas the ports for the second fluid are arranged to communicate with a second passing space delimited by the opposite second side of the plate in the area of the heat transfer portion, wherein the plate has a symmetry line (S), which extends from the first edge (2; 102; 202) to the second edge (3; 103; 203) of the plate and in relation to which the plate's heat transfer portion, sealing portions and ports to be passed by each of the fluids are symmetrically arranged, and the elevations and depressions (30; 130; 230) are arranged relative to the symmetry line (S) in such maimer that when two identical plates are brought to abut against each other—one of the plates being rotated through 180 degrees about the symmetry line (S) relative to the other—the elevations (30; 130; 230) of the plates will form distance means between the plates in a number of places distributed over the heat transfer portions (10; 110; 210) of the plates and every second heat transfer plate being rotated through 180 degrees about the symmetry line so that the heat transfer plates of the plate pack abut against each other with the first side (1*a*; 101*a*; 201*a*) of the respective plates facing the first side (1*a*; 101*a*; 201*a*) of an adjacent plate and the second side (1*b*; 101*b*; 201*b*) of the respective plates facing the second side (1*b*; 101*b*; 201*b*) of an adjacent plate, and further wherein the plates are permanently and sealingly interconnected in pairs to form pairs of plates and gaskets are arranged between adjacent pairs of plates.

* * * * *

UNITED STATES PATENT AND TRADEMARK OFFICE

CERTIFICATE OF CORRECTION

PATENT NO. : 6,823,934 B2
DATED : November 30, 2004
INVENTOR(S) : Jarl Andersson It is certified that error appears in the above-identified patent and that said Letters Patent is hereby corrected as shown below:

Column 10,
Lines 38 and 43, change “gassed” to -- passed --.
Line 51, change “(11-13: 11, 112:” to -- (11-13; 111, 112; --.

Column 12,
Line 8, change “(122, 122)” to -- (121, 122) --.
Line 51, change “(11-13: 11, 112:” to -- (11-13; 111, 112; --.

Column 13,
Line 12, change “maimer” to -- manner --.

Signed and Sealed this

Third Day of May, 2005

JON W. DUDAS
*Director of the United States Patent and Trademark Office*